US007100285B1

(12) United States Patent
Huang

(10) Patent No.: US 7,100,285 B1
(45) Date of Patent: Sep. 5, 2006

(54) SELF-OPENING HANDLE FOR A HEAVY DUTY ARTISTIC KNIFE

(76) Inventor: Yin-Hai Huang, P.O. Box 697, Feng-Yuan City, Taichung Hsien (TW) 420

( * ) Notice: Subject to any disclaimer, the term of this patent is extended or adjusted under 35 U.S.C. 154(b) by 0 days.

(21) Appl. No.: 10/705,839

(22) Filed: Nov. 13, 2003

(51) Int. Cl.
*B26B 1/08* (2006.01)

(52) U.S. Cl. ..... 30/162; 30/125

(58) Field of Classification Search ..... 30/162, 30/125, 335

See application file for complete search history.

(56) References Cited

U.S. PATENT DOCUMENTS 5,022,156 A * 6/1991 Kallens et al. ..... 30/125
5,862,596 A * 1/1999 Chung ..... 30/162
6,513,246 B1 * 2/2003 Ping ..... 30/125

* cited by examiner

*Primary Examiner*—Douglas D Watts

(57) ABSTRACT

A self-opening handle for a heavy duty artistic knife includes a handle which is combined with a pair of corresponding halves and rotatably connected on their rear ends, a blade rack slidably disposed in the front portion, a blade chamber formed in the rear portion and a swivel lock locking the lower middle portion thereof. The feature is that a magnet disposes in a lower inner wall of each of the corresponding halves with the identical pole toward each other so that when the swivel lock is at a unlocking position, the pair of corresponding halves will automatically open a large angle due to the expelling force of the magnets. Therefore providing a convenient and swift changing of the blade from the blade rack.

4 Claims, 7 Drawing Sheets

(5-5)

SELF-OPENING HANDLE FOR A HEAVY DUTY ARTISTIC KNIFE

BACKGROUND OF THE INVENTION

The present invention relates to heavy duty artistic knives and more particularly to a self-opening handle for a heavy duty artistic knife which utilizes the expelling force of a pair of magnets to automatically open the handle.

A prior art heavy duty artistic knife 10 (as shown in FIGS. 1 and 2) has a handle combined by a pair of corresponding first and second halves 11 and 12, a cleat 13 fastening their rear end, and a recess 111 in the front end of the first half 11 for engaging within a projection 121 at the front end of the second half 12. When changes the blade, one has to remove the cleat 13 at first and slides the second half 12 rearward to disengage with the first half 11, then removes the blade out of the blade rack. After the changing of a new blade, one should do the same job reversely. Therefore, it is inconvenient.

Some of the producers adds a pair of magnets inside the handle with positive pole facing the negative pole in order to enhance the stability of the handle. However, the second half 12 could not easily disengage with the first half 11 except disposing a spring therein to eject the second half 12 from the first half 11. This arrangement not only wastes the material but also causes the loosening of the blade rack.

SUMMARY OF THE PRESENT INVENTION

The present invention has a main object to provide a self-opening handle for a heavy duty artistic knife. When unfastens a swivel lock, the handle automatically opens a large angle to facilitate the blade changing without loosening the blade rack.

Accordingly, the self-opening handle for a heavy duty artistic knife of the present invention comprises generally a handle which is combined with a first and a second corresponding halves and pivoted together on their rear ends, a swivel lock locking a middle portion of the handle, a blade rack slidably disposing in the front portion and a spare blade chamber in the rear portion thereof. It is characterized in that a pair of magnets respectively disposing in an inner wall adjacent the rear end of the first and second halves with their positive poles facing each other. When unfastens the swivel lock, the two halves will automatically open a large angle due to the expelling force of the magnets. Therefore facilitating the changing of a new blade without loosening the blade rack or disengaging the second half with the first half.

The present invention will become more fully understood by reference to the following detailed description thereof when read in conjunction with the attached drawings.

DETAILED DESCRIPTION OF THE PREFERRED EMBODIMENT

Figure 1:
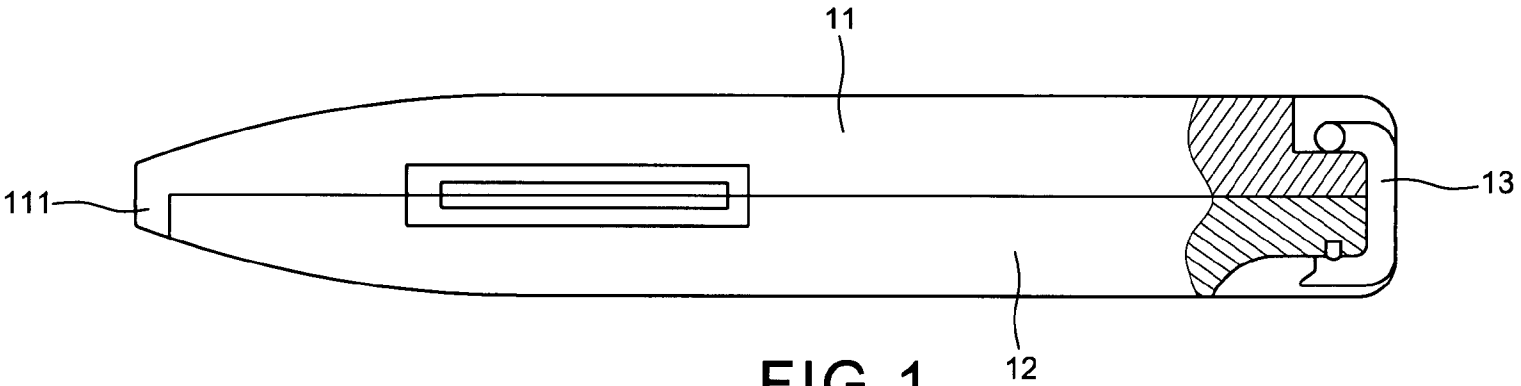
FIG.1 Prior Art
FIGS. 1 and 2 are the plane views of a heavy duty artistic knife according to a prior art.
Figure 2:
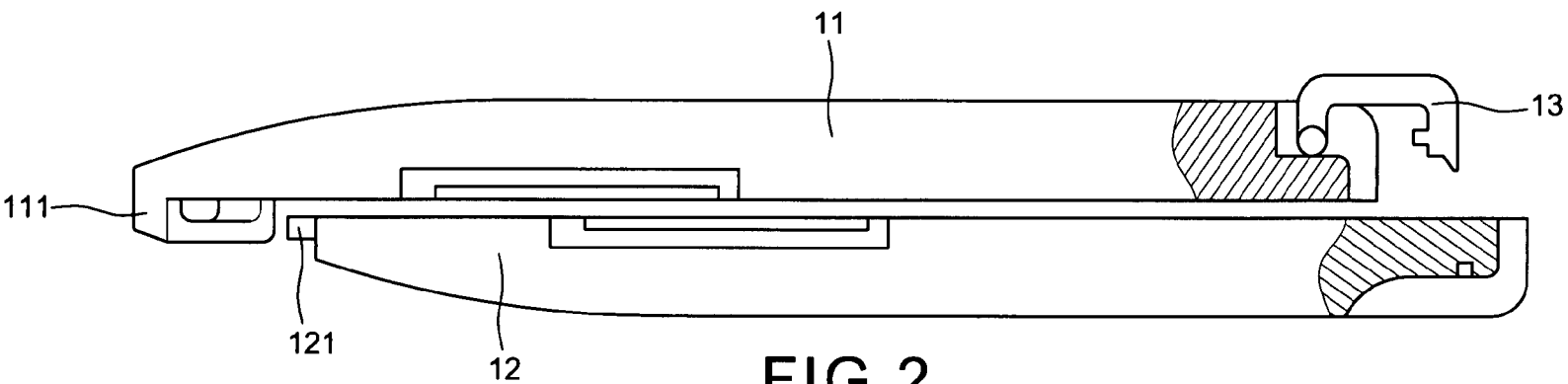
FIG.2 Prior Art
Figure 3:
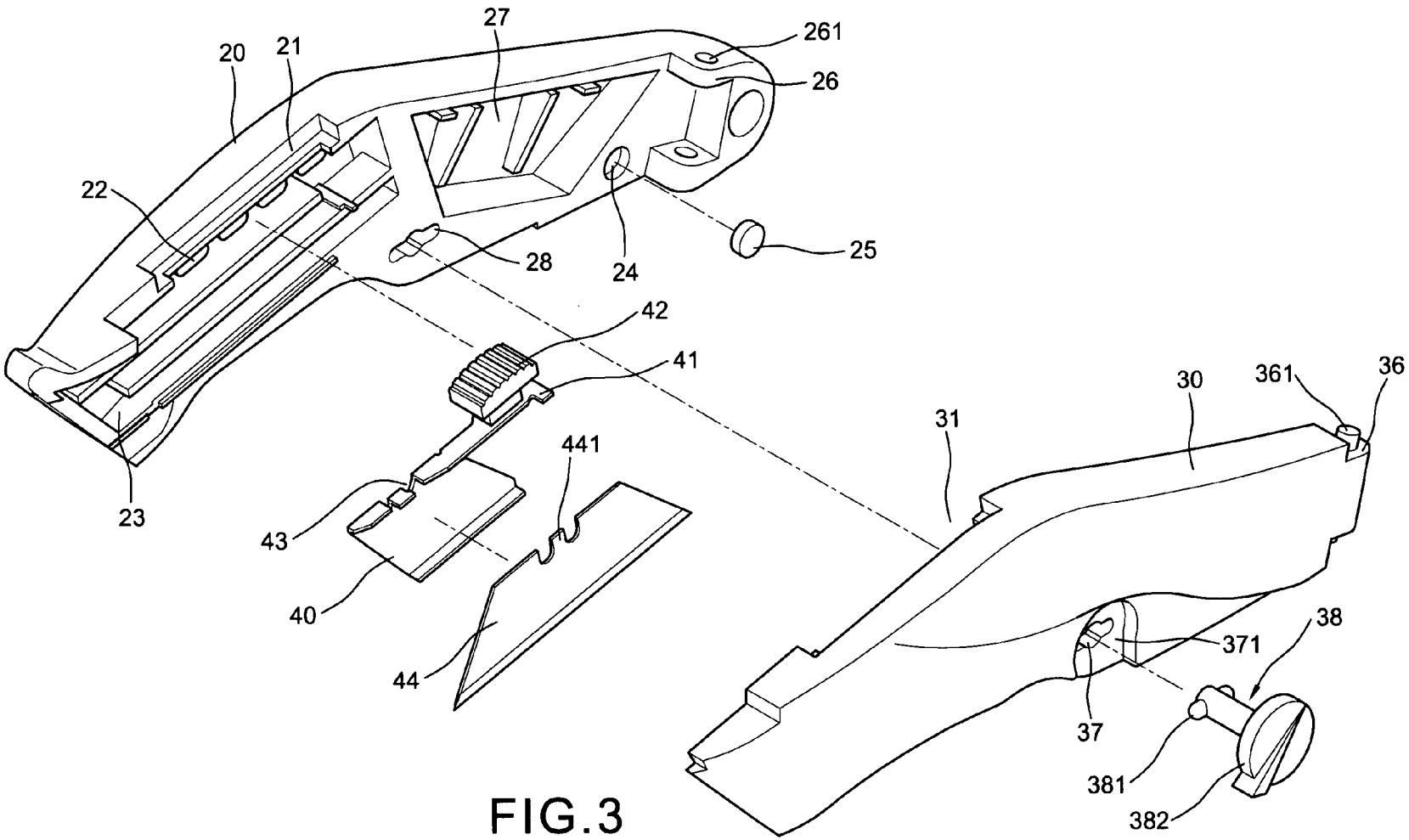
FIG. 3 is an exploded perspective view of a heavy duty artistic knife of the preferred embodiment according to the present invention.

With reference to drawings and initiated from FIGS. 3, 4, 5 and 6. The self-opening handle for a heavy duty artistic knife of the present invention comprises a handle which is combined with a first and second corresponding halves 20 and 30 and each has an elongate guide groove 21 and 31 in front top engaged with each other to define a gap therebetween, a plurality of transverse stop blocks 22 and 32 spacedly disposed on the underside of the grooves 21 and 31, a plurality of longitudinal ribs 23 and 33 spacedly formed under the stop blocks 22 and 32 to define a sliding space thereinbetween, a horizontal slot 28 and 37 in a lower middle portion engaged with each other wherein the slot 28 is within a deep small circular depression 281 and the slot 37 is within a shallow large semi-circular depression 371, a circular recess 24 and 34 in a lower inner wall adjacent their rear ends engaged with each other for respectively disposing therein a pair of magnets 25 and 35 which have their similar poles positioned face to face in order to create an expelling or reaction force. Meanwhile, the first corresponding half 20 further has a lug 26 with an aligned through hole 261 on rear end and the second corresponding half 30 has a projection 36 with a pair of axial rods 361 on lateral side engaged with the aligned through hole 261 of the lug 26 such that the second corresponding half 30 is hinged on the first corresponding half 20 and a blade chamber 27 in a rear portion for disposing the spare blades 40.

A blade rack 40 slidably dispose in the front end of the handle. The blade rack 40 has a stop plate 41 at rear end engageable with any of the stop blocks 22 and 32, a striped sliding plate 42 on the top of the stop plate 41 and slidably disposed in the elongate grooves 21 and 31 and a pair notches 43 spacedly formed on one side for engaging with a fin 441 of a trapezoid shape blade 40.

Figure 7:
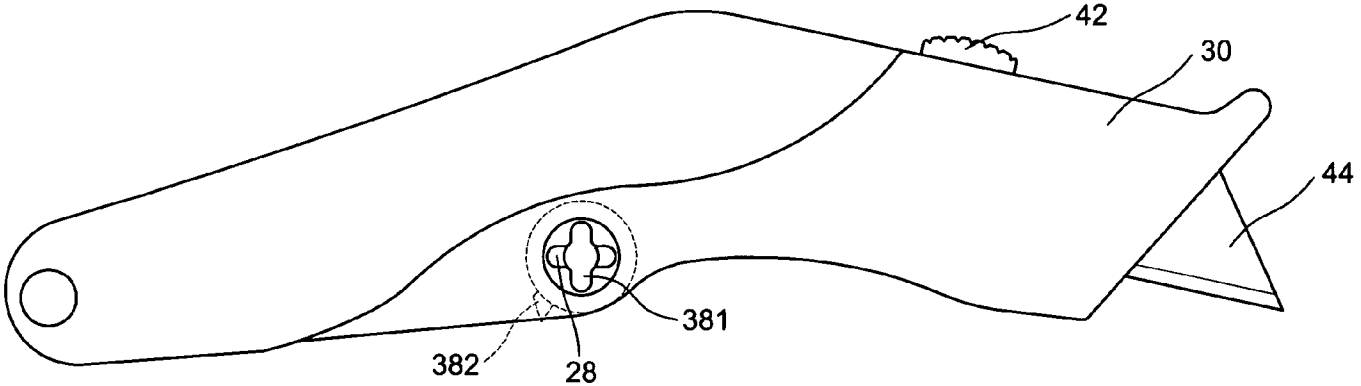
FIG. 7 is a backside view to show that the swivel lock is locked up.

A swivel lock 38 has a T-shaped shank 381 inserted through the horizontal slot 28 and 37 and a swivel button 382 on outer end engaged into the semi-circular depression 371 of the second corresponding half 30. When rotates the swivel button 382 for about 90 degrees, the handle is locked up (as shown in FIG. 7).

Figure 4:
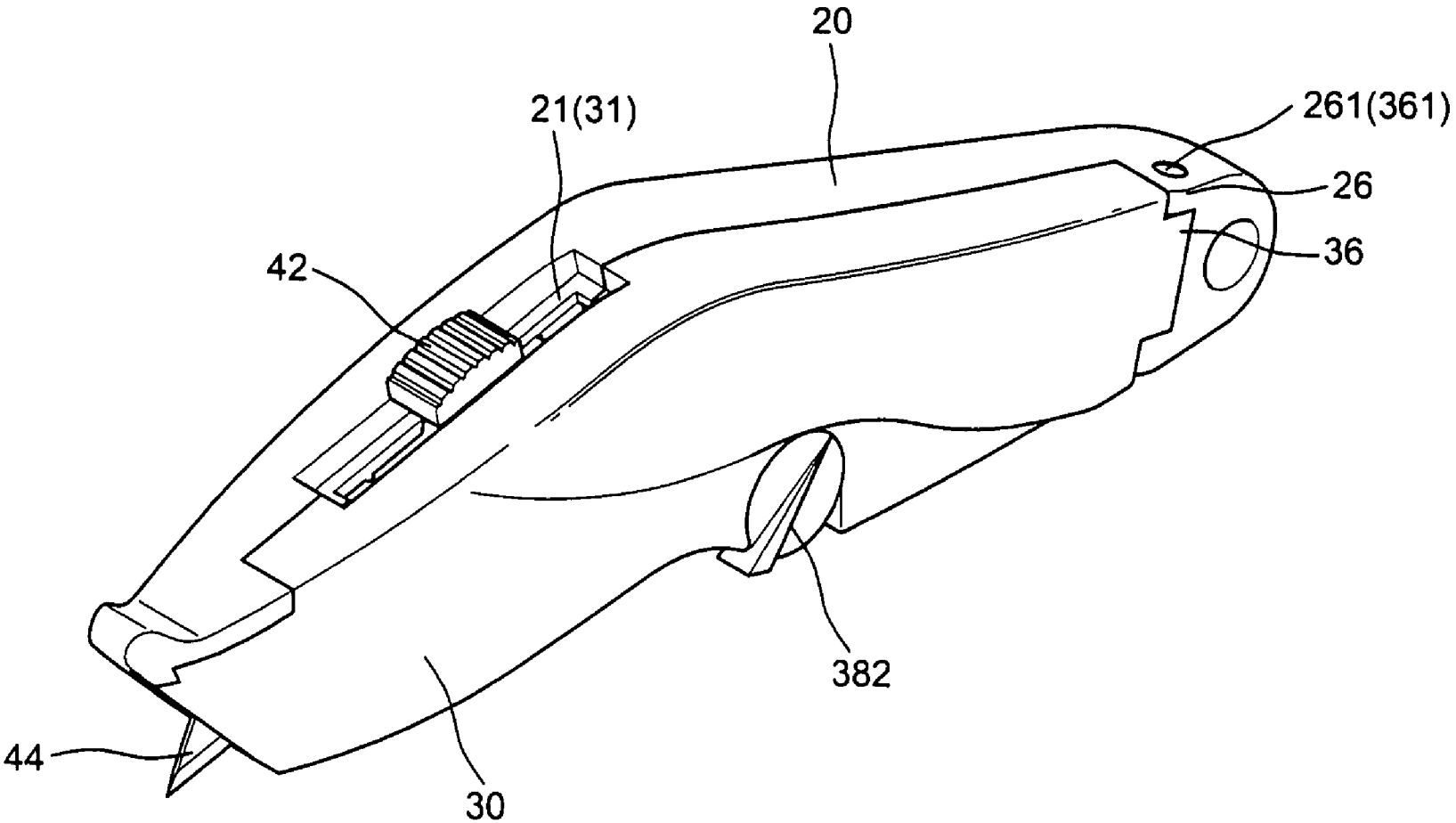
FIG. 4 is a perspective view to show the assembly of FIG. 3.
Figure 5:
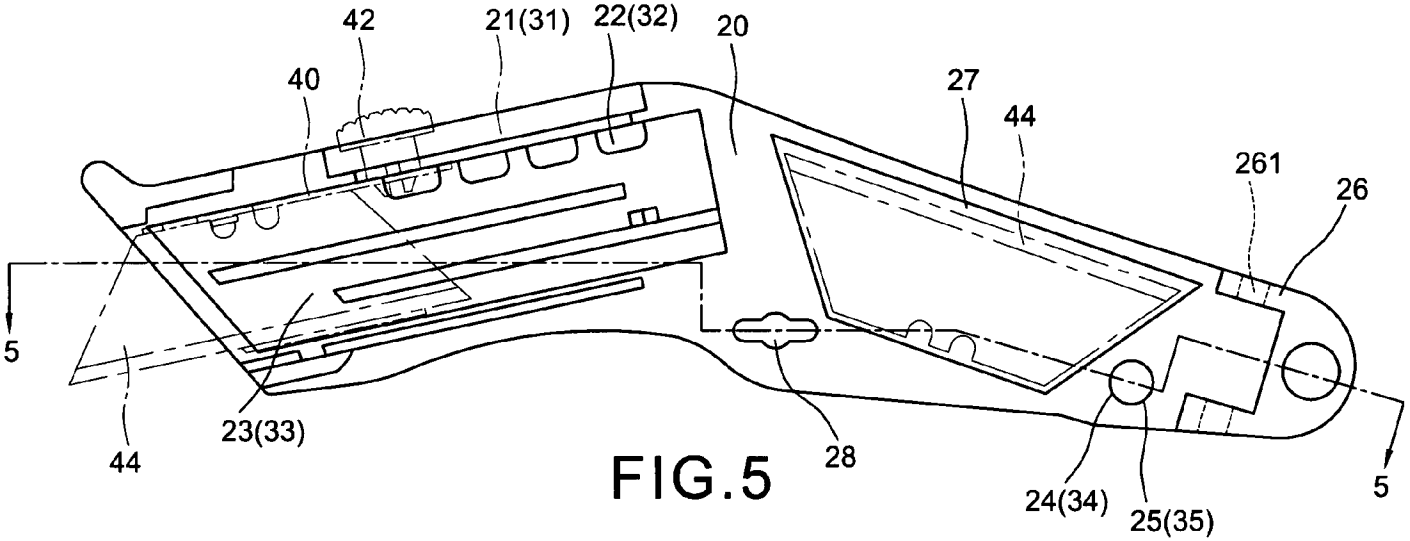
FIG. 5 is a plane view of FIG. 4.
Figure 6:
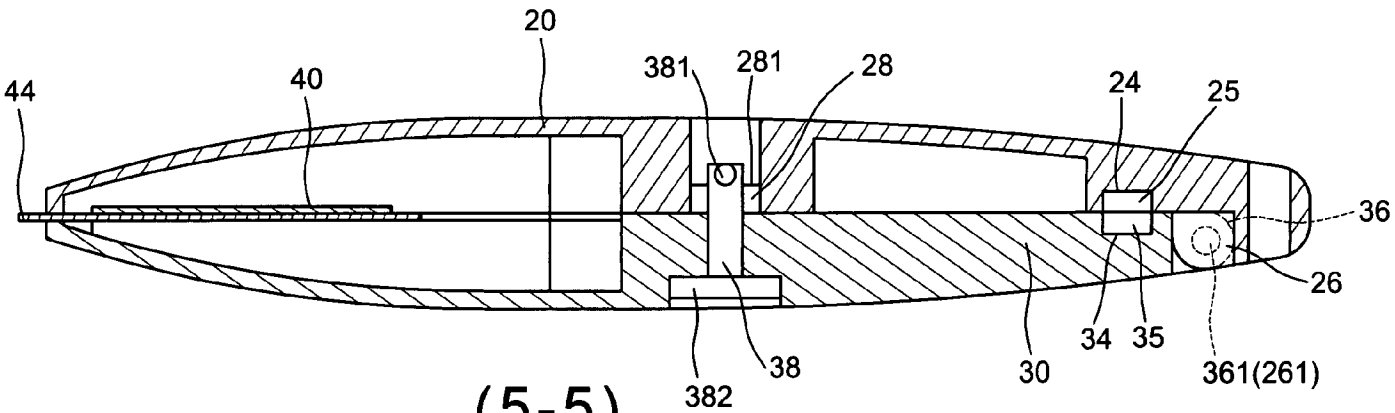
FIG. 6 is a sectional view taken along line 5—5 of FIG. 5.
Figure 9:
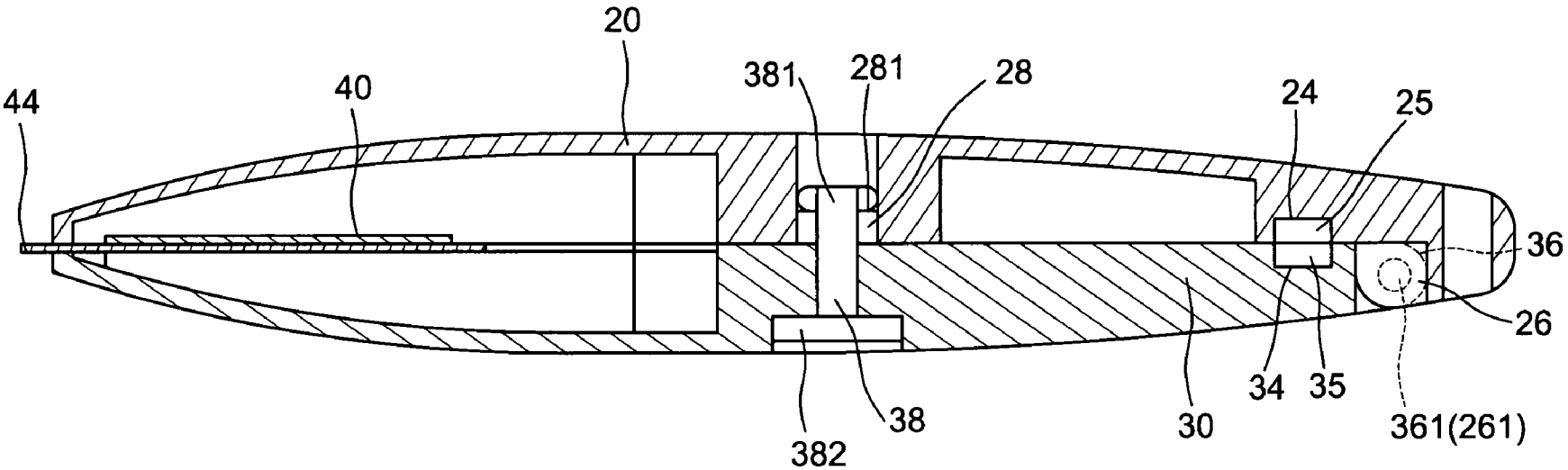
FIG. 9 is a sectional view to show the assembly of the heavy duty artistic knife of the present invention.

FIGS. 4, 6 and 9 show an assembled heavy duty artistic knife of the present invention. In use, the blade rack 40 can be moved to and fro by pressing down the striped slider 42 to have the stop plate 41 disengaged with the gaps between the stop blocks 22 and 32 and selected a suitable gap to release the striped slider 42, then the stop plate 41 will be automatically engaged into that gap and the heavy duty artistic knife may begin to use.

Figure 8:
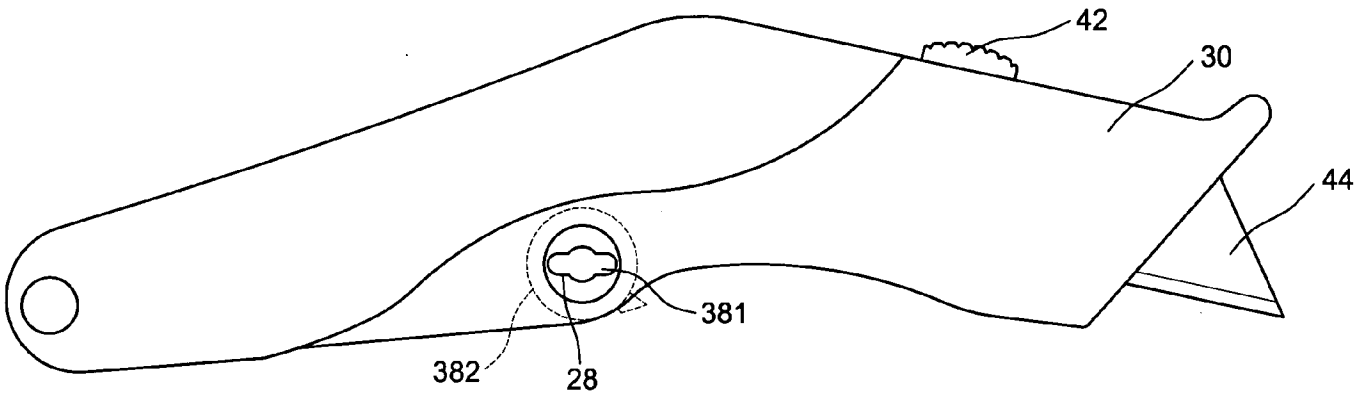
FIG. 8 is a backside view to show that the swivel lock is about to unlocked up.
Figure 10:
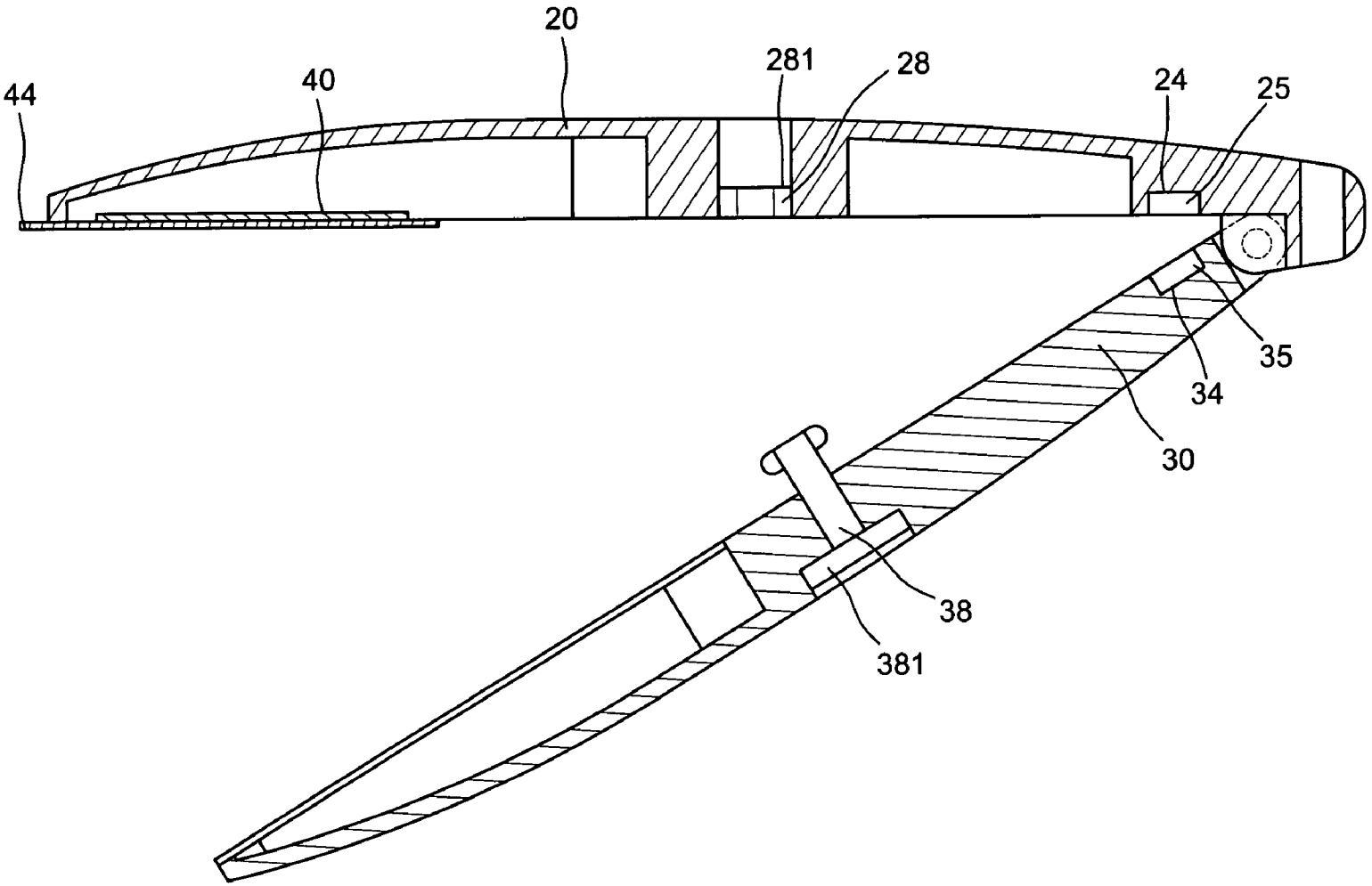
FIG. 10 is a sectional view to show the opening of the second half from the first half.

When changes a blade 44 on the blade rack 40, rotates the swivel button 382 for about 90 degrees again to have the T-shaped shank 381 engaged with the slots 28 and 37, the second corresponding half 30 will automatically open a large angle due to the spelling force of the pair of the magnets 25 and 35. Then picks up a new blade 44 from the blade chamber 27 and replaces the old one without moving the blade rack 40 (as shown in FIGS. 8, 9, 10). Once the two halves 20 and 30 are locked up by swivel lock 38, the heavy duty artistic knife may work again.

The feature of the present invention is of the pair of magnets 25 and 35 and the hinged the second corresponding half 30 upon the first corresponding half 20. The magnets 25 and 35 provide expelling force to force the second corresponding half 30 to automatically open. However, if the magnets 25 and 35 are positioned at front portion of the handle, the opening angle will be relatively small. That's why the magnets 25 and 35 are positioned at rear portion of the handle that the opening angle will be relatively larger. Nevertheless, this arrangement can be adopted to similar apparatus and the hinged connection of the two halves 20 and 30 can be also modified. But any modification should be in the scope of the present invention.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. A self-opening handle for a heavy duty artistic knife comprising:

a handle which is comprised of a first and a second corresponding halves and each has an elongate groove in front top engaged with each other to define a gap therebetween, a plurality of transverse stop blocks spacedly formed under said elongate grooves, a plurality of longitudinal ribs spacedly formed under said stop blocks to define a sliding space thereinbetween, a horizontal slot in the lower middle portions made in registry with one another and a circular recess in a lower inner wall adjacent rear end of each of said corresponding halves engageable with each other for disposing a magnet therein, wherein said first corresponding half further has a blade chamber in rear portion, a deep small circular depression in an outer surface surrounding said horizontal slot and a lug with an aligned through hole on rear end thereof; said second corresponding half further has a semi-circular depression in an outer surface surrounding said horizontal slot and a projection with a pair of lateral axial rod at rear end rotatably engaged with the aligned through hole of said lug of said first corresponding half;

a blade rack slidably disposed in front portion of said handle having a stop plate at rear end engageable with said transverse stop blocks, a striped slider above said stop plate slidably engaged within said elongate grooves and a pair of notches spacedly formed on one side for engaging with a fin on middle top of a trapezoid shape blade;

a swivel lock locking a middle portion of side first and second halves having a swivel button engaged with said semi-circular depression and a T-shaped shank centrally projected from inner side of said swivel button and inserted through said horizontal slots.

2. The heavy duty artistic knife as recited in claim 1, wherein said pair of magnets are positioned with their identical poles toward each other.

3. The heavy duty artistic knife as recited in claim 1, wherein said swivel lock has to turn about 90 degrees when locking and unlocking said corresponding halves.

4. The heavy duty artistic knife as recited in claim 1, wherein said stop plate is selectively disengaged with said transverse stop blocks when said striped slider is pressed downward.

* * * * *